United States Patent [19]

Nava et al.

[11] Patent Number: 4,759,304

[45] Date of Patent: Jul. 26, 1988

[54] DEVICE FOR CONTROL AND REGULATION OF UPPER FEED MECHANISM OF OVERLOCK SEWING MACHINE

[75] Inventors: Erminio Nava, Milan; Franco Marchesi, Pavia, both of Italy

[73] Assignee: Rockwell-Rimoldi, S.p.A., Italy

[21] Appl. No.: 77,488

[22] Filed: Jul. 24, 1987

[51] Int. Cl.[4] ..... D05B 27/00

[52] U.S. Cl. ..... 112/311; 112/320

[58] Field of Search ..... 112/311, 320, 312, 314

[56] References Cited

U.S. PATENT DOCUMENTS

| | | | |
|---|---|---|---|
| 4,285,294 | 8/1981 | Aida | 112/311 |
| 4,503,794 | 3/1985 | Ishara | 112/320 X |
| 4,589,364 | 5/1986 | Yamamoto et al. | 112/311 |

*Primary Examiner*—Ronald Feldbaum

[57] ABSTRACT

An improved guide device for the horizontal motion mechanism for the upper feed dog of an overlock sewing machine including an angularly adjustable bracket element that cooperates with a vertically adjustable slide to provide adjustability in the amount of shaft oscillation while attaining higher operating speeds.

2 Claims, 1 Drawing Sheet

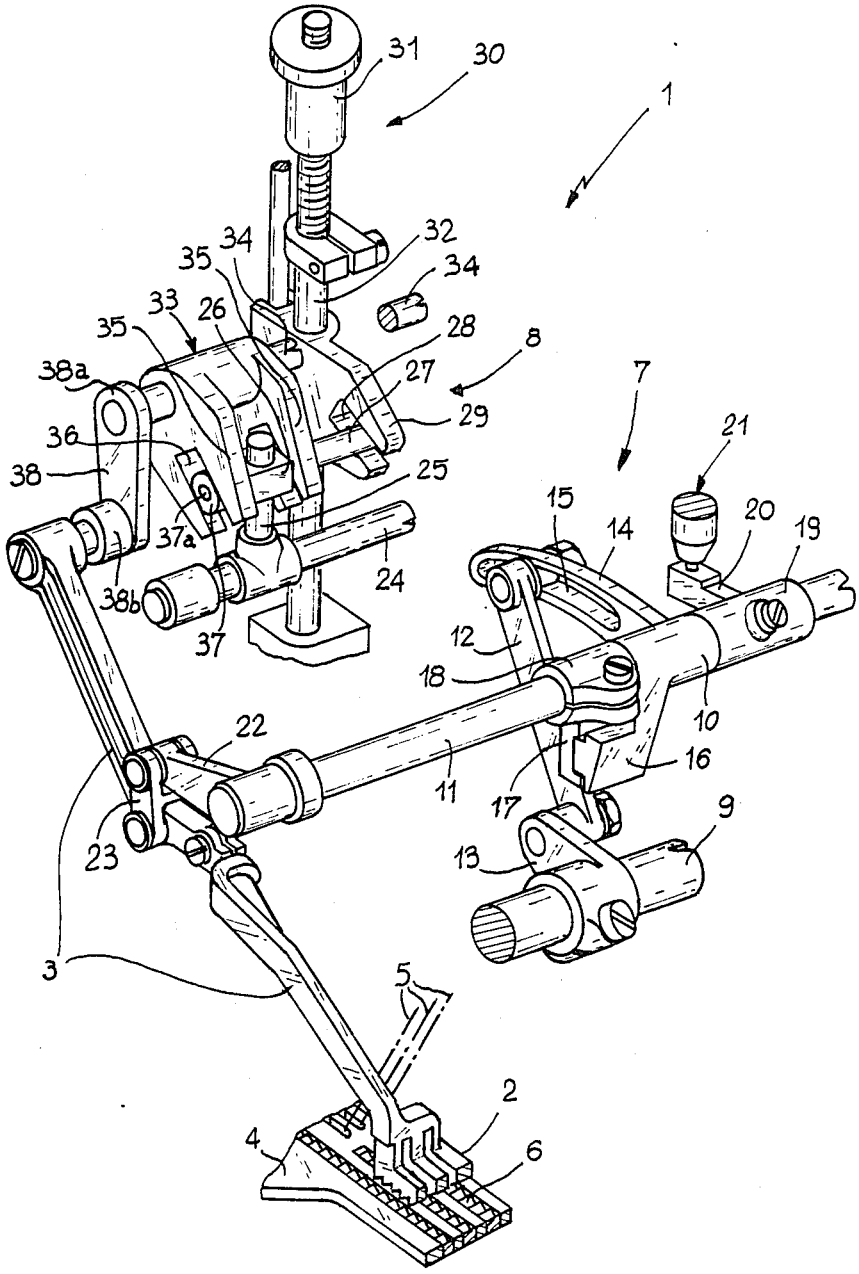
31
30
1
32
34
35
34
33
26
28
8
35
38a
27
7
29
36
21
38
25
15
20
19
37a
14
24
38b
37
12
18
10
22
16
11
17
9
23
13
3
5
2
4
6

DEVICE FOR CONTROL AND REGULATION OF UPPER FEED MECHANISM OF OVERLOCK SEWING MACHINE

BACKGROUND OF THE INVENTION

This invention relates to a device for the control and regulation of the upper feed mechanism in an overlock sewing machine.

The upper feed mechanism includes at least one upper feed dog which turns above a needle plate by utilizing in conjunction a vertical motion mechanism and a horizontal motion mechanism consisting of a control shaft which rotates on its axis, a slide lever which extends out from the control shaft, a slider attached to the slide lever, a support consisting of a sliding guide seat attached to a protruding section of the slider, and a drive attached to the slide which activates the upper feed dog to move in generally a horizontal fashion.

Obviously, an overlock sewing machine may be equipped, other than the lower feed dogs which work in conjunction with the needle plate, with an upper feed mechanism consisting of an upper feed dog which operates above a needle plate. In particular, the upper feed dog is activated to work in conjunction with one of the lower feed dogs in order to feed the fabric being sewn in the direction of the needle or needles during the sewing operation.

For this purpose, the upper feed dog moves basically in an elliptical motion, which is generated by means of a vertical motion mechanism which cooperates with a horizontal motion mechanism. These two mechanisms are synchronized and operate along a support shaft of the upper feed dog in order to make the upper feed dog oscillate in a vertical and in a horizontal fashion.

In summary, the horizontal motion mechanism allows for the use of many elements which work in conjunction in order to activate a shaft to turn around its axis. From this shaft extends an arm attached to the support shaft of the upper feed dog by means of pivot, in order to raise and lower the feed dog in the oscillating fashion indicated above.

The horizontal motion mechanism consists of a control shaft which oscillates around its axis, from which a slide lever extends. A slide is connected to the slide lever on one side at a movable projection attached to a guide seat connected to a support. On the other side, the slide consists of a pusher connected at a slot which is attached to a movable block guide which moves along a shaft. This movable block is rigidly attached to a fixed portion of the sewing machine and extends horizontally, perpendicular to the control shaft.

A connector extends from the block and moves across a slot in a fixed portion of the sewing machine and which extends parallel to the above-mentioned shaft. At the opposite end of the block, the connector is attached to turn at an end of the feed dog support shaft.

Operation of the horizontal motion mechanism allows the oscillating motion of the control shaft to be transmitted, by means of the slide lever and the slide, to the block which moves alternately in conjuntion with the shaft that supports it. The horizonal turning motion is thus transmitted to the upper feed dog shaft by means of the connector.

The horizontal motion mechanism also includes regulating devices which, acting on the support, move the slide along the slide lever and position said slide at the proper place along the slide lever. The position of the slide along the slide lever depends on the range of horizontal movement from the upper feed dog.

As described, the customary control devices raise various problems in operation in high speed machines.

The cause of these problems is primarily due to the fact that, in regard to the horizontal motion mechanism, the movement of the block along the shaft is obtained by force which, by means of the slide, is applied at points which are relatively far from the axis of the shaft on which the block is to slide. this results in flexing which is transmitted from the block to the shaft, and which is considerably increased by the effect of inertia which comes into play during operation. The presence of flexing causes strong friction between the block and the shaft which results in early and irregular wear of said elements and, in high speed machines, undesirable cut-offs.

These phenomena may be noted even if, in imperfect operation, the slot through which the connector is guided is not perfectly parallel to the shaft on which the block moves.

It is evident that precise operation is required and, although costly to manufacture, the slot and the shaft must be perfectly parallel. Notwithstanding the above, the parallel position of the slot and the shaft may be easily altered due to irregular wear of the shaft caused by the above-mention phenomena.

Another problem encountered in the devices described above is due to the fact that regulation of the horizontal motion of the upper feed dog causes an increase or decrease in said motion, either in moving toward the needle or needles when/they are inside the dog or in moving away from the needles(s). Regulation may be performed only within very restrictive limits, because too much of an increase in the motion may cause interference between the upper feed dog and the needle or needles.

SUMMARY OF THE INVENTION

The object of this invention is primarily to resolve the above-mentioned problems by means of a device for controlling and regulating the upper feed mechanism which may be obtained by simply modifying the customarily used devices, in regard to the horizontal motion mechanism of these device.

This and other objects, which will be described further on, primarily correspond to a device for controlling and regulating the upper feed mechanism of an overlock sewing machine, consisting of at least one upper feed dog which oscillates above a needle plate by working in conjunction with a vertical motion mechanism and a horizontal motion mechanism.

More characteristics and advantages will be appear further on in a detailed description of the preferred but not exclusive form of implementing the device for controlling and regulating the upper feed mechanism of an overlock sewing machine according to the invention, which correspond to the attached drawing, which is provided by way of illustration but not limitative in which:

DESCRIPTION OF THE DRAWING

The FIG. is partially detached perspective schematic illustration of the control and upper feed mechanism of the invention.

DESCRIPTION OF THE PREFERRED EMBODIMENT

Referring to the drawing, a device 1 is provided for controlling and regulating the upper feed mechanism in an overlock sewing machine according to this invention.

In the customary manner, the device 1 consists of at least one upper feed dog 2, which is illustrated in a partial view, properly supported as described further on, by a support 3 which extends above the feed dog.

The upper feed dog oscillates above a needle plate 4 (partially illustrated and, in regard to the direction in which the fabric moves, either in front of or behind one or more needles which move alternately through the needle plate 4 according to the pattern illustrated schematically by line 5, during operation, the upper feed dog 2 is designed to work in conjunction with a lower feed dog 6 which both move through the needle plate 4 in the customer manner in order to advance the fabric being sewn in the direction of the needles.

For this purpose, the upper feed dog 2 is controlled by a vertical motion mechanism 7 and a horizontal motion mechanism 8.

The vertical motion mechanism 7 is of conventional design and operates between support 3 in order to move the upper feed dog 2 alternately in a vertical direction.

In particular, the vertical motion mechanism 7 includes a first control shaft 9 which turns on its axis by means of parts of the sewing machine which are not illustrated, as they are conventional and are not relevant to this invention.

The first control shaft 9 transmits its oscillating motion to a sleeve 10 attached in a neutral position on the first support shaft 11, which in turn is connected in a movable fashion to a fixed portion of the sewing machine. For this purpose, operation of the control shaft 9 must be connected to the sleeve 10 by means of a connecting rod 12 and lever 13. The connecting rod 12 pivots on an oscillating arm 14 which extend from the sleeve 10. The pivot point of the connecting rod 12 may be positioned in a lengthwise slot 15 in the arm 14, and then fixed at the desired point, depending on the position of the vertical movement upper feed dog 2.

From the sleeve 10 extend a pusher 16 which comes into contact with a permanent connection 17 in the first boss 1 fit in the support shaft 11.

Also fit into the control shaft 11 is a second boss 19 with a second connection 20 with elastic components 21, illustrated schematically. The elastic components allow the support shaft 11 to rotate so that the first connection 17 is pushed in the direction of the pusher 16.

As indicated in the attached drawing, the support shaft 11 msut be connected to the upper feed dog 2 by means of a lifting arm 22, at the free end of which a connector 23 pivots. This connector 23 turns the support 3 of the upper feed dog 2. Operation of the vertical motion mechanism 7 primarily is designed so that oscillation of the first control shaft 9 is transmitted to the first support shaft 11 by working in conjunction with the pusher 16 in the connection 17 an the elastic components 21 which act on the second connection 20. The oscillation of the support shaft 11 obtained in this manner is then transformed into primarily vertical oscillation of the upper feed dog 2 of the portion of the lifting arm 22 and the connector 23.

The horizontal motion mechanism 8 consists of a second control shaft 24 which turns on its axis in conventional manner. From the shaft, a slide lever 25 extends, along which a slide 26 is connected in a sliding fashion. The slide 26 is equipped with a fixed portion which, in the drawing, consists of an elbow 27 which is attached to a guide seat 28 connected to support 29.

Attached to the support 29 in a conventional manner are regulators, which are grouped together in the illustration as No. 30, primarily consisting of a regulator locknut 31 on a threaded shank 32, which is connected to the support 29. The locknut 31 is attached to a fixed portion of the sewing machine which is not illustrated in the drawing so that by operating the locknut itself, it is possible to raise or lower the support 29 from the control shaft 24. The movements of the support 29 in the above-mentioned manner correspond to those of the slide 26 along the slide lever 25, so that the slide 26 may be placed in many positions, corresponding to the motion transmitted to the feed dog 2 by the horizontal motion mechanism 8, as described herein.

The novelty and advantage of the invention is that the horizontal motion mechanism 8 consists of a bracket-fit element 33 to the second support shaft 34 parallel to the control shaft 24 and supported in a movable fashion to a fixed portion of the sewing machine which is not illustrated.

The bracket-fit element 33 consists of a pair of parallel arms 35 which are arranged symmetrically in relation to the slide lever 25. Each of the arms 35 has a slide seat 36 which extends at a predetermined angle perpendicular to the plane of the axis of the control shaft 24 and the support shaft 34.

Each slide seat 36 is attached in a movable manner to a pusher 37 connected to the slide 26. In the preferred manner of implementing the invention, the pushers 37, only one of which is visible in the illustration, are attached in a movable manner to the slide 26, each corresponding to a shaft **37*a***.

The horizontal motion mechanism is attached to the upper feed dog 2 by a crank arm 38 with one end **38*a* fit to the support shaft 34 and the other end 38*b* connected in a movable fashion to the support shaft 3** at the free end of the said shaft.

In summary, operation of the horizontal motion mechanism 8 is designed so that the oscillation of the control shaft 24 is transmitted to the support shaft 34 by working in conjuntion with the slide 26 and the bracket-fit element 33, to then be transmitted, oscillating in a horizontal direction, to the stem 3 and then to the upper feed dog 2 by the crank lever 38.

An advantage of the invention is that the predetermined fixed oscillation of the control shaft 24 is transmitted to the support shaft 34 as more or less emphasized oscillation in relation to the position of the slide 26 along the slide lever 25, and the position of the pusher 27 on the slide seat 36.

In particular, it is to be noted that the oscilation of the slide 26 provided by the control shaft 24 is directly proportional to the distance of the slide 26 from the axis of the control shaft. On the other hand, the oscillation transmitted by the slide 26 to the support shaft 34 is inversely proportional to the distance of the slide from the axis of the control shaft 34.

It may be deduced that when the slide 26 is near the shaft 24, the oscillation transmitted to the support shaft 34 is slight, in accordance with the minimum horizontal motion travelled by the upper feed dog 2 during operation. On the contrary, when the slide 26 is near the free end of the slide lever 25, the oscillation transmitted to the support shaft 34 is maximum, in accordance with the maximum motion of the upper feed dog 2 during operation.

By means of this invention, transmission of the oscillating motion from the shaft 24 to the support shaft 34 and then to the upper feed dog 2 is attained without generating undesired flexural movement which result in specific problems as encountered with conventional devices. It is also important to note that, with bracket-fit arms 33 arranged symmetrically in relation to the slide lever 25, the flexural movement generated during operation between the lever 25 and the arms 35 are reciprocally suppressed, without affecting the control, shaft 34 and the operation of the device in general.

This advantage allows operation of the device 1 at considerably higher speeds that the speeds at which the conventional devices operate, without resulting in early and/or abnormal wear of the elements or unusual noise or vibration. The device may also be implemented by simply modifying the conventional devices. It is emphasized that by properly selecting the reciprocal position between the slide lever 25 and the bracket arms 33, it is possible to regulate the course of the upper feed dog without having the "dead point" of the return course toward the needles exceed the plane of the needles. With each increase in the course of the feed dog (advance and return) according to the invention, the center of the elliptical trajectory of the feed dog during operation is moved away from the plane of the needles. Thus, the risk of interference between the needles and the upper feed dog 2 is eliminated, thus resulting in improved regulation of the course of the feed dog. Naturally, numerous modifications and variations may be made to this invention, without exiting from the sphere of the concept which characterizes the invention.

We claim:

1. In a device for controlling and regulating the upper feed mechanism of an overlock sewing machine, consisting of at least one upper feed dog which moves in an oscillating manner above a needle plate by the cooperation of a vertical motion mechanism and a horizontal motion mechanism which includes:

a control shaft which turns on its axis;

at least one slide lever which extends from the control shaft;

a slide attached in a movable fashion to the slide lever;

at least one support with a guide seat attached in movable manner to a fixed portion of the slide;

regulators for the support to position the slide along the slide lever;

transmission elements which work with the slide to make the upper feed dog oscillate in a horizontal manner, the improvement comprising:

(a) a support shaft attached in a movable fashion to a fixed part of the sewing machine parallel to the control shaft;

(b) a bracket-fit element attached to the support shaft, consisting of a pair of arms placed symmetrically in relation to said slide lever, each with a slide seat in which a pusher is attached from the slide; and (c) a crank arm with one end fit in the support shaft and one end working with a support of the feed dog in order to make the feed dog oscillate in a horizontal direction.

2. A device in accordance with claim 1, wherein each pusher is attached to rotate on the slide.

* * * * *